US005133018A

United States Patent [19]

Miyazaki

[11] Patent Number: 5,133,018

[45] Date of Patent: Jul. 21, 1992

[54] AUDIO SPEAKER CONNECTOR EMPLOYING CONCENTRICALLY ORIENTED SPEAKER CONTACTS

[75] Inventor: Masaaki Miyazaki, Canton, Mich.

[73] Assignee: Ford Motor Company, Dearborn, Mich.

[21] Appl. No.: 466,842

[22] Filed: Jan. 18, 1990

[51] Int. Cl.[5] ..... H04R 1/02

[52] U.S. Cl. ..... 381/205; 381/190

[58] Field of Search ..... 381/87-90, 381/188, 205, 114, 116, 117, 111, 192, 190, 191

[56] References Cited

U.S. PATENT DOCUMENTS

| | | | |
|---|---|---|---|
| 3,108,654 | 10/1963 | Hammes | 181/31 |
| 3,133,162 | 5/1964 | Coen | 179/119 |
| 3,159,234 | 12/1964 | Junk | 181/31 |
| 3,170,538 | 2/1965 | Detrick | 181/31 |
| 3,328,869 | 7/1967 | Lannert | 29/160 |
| 3,377,144 | 4/1968 | Lannert | 29/183 |
| 3,452,325 | 6/1969 | Paulve | 339/269 |
| 3,666,040 | 5/1972 | Junk | 181/31 R |
| 3,757,890 | 9/1973 | Dunning | 181/31 B |
| 4,082,159 | 4/1978 | Petty | 181/156 |
| 4,295,009 | 10/1981 | Weidler | 381/205 |
| 4,439,643 | 3/1984 | Schweizer | 381/90 |
| 4,546,850 | 10/1985 | Litner | 181/141 |
| 4,565,905 | 1/1986 | Nation | 179/115.5 PC |
| 4,625,829 | 12/1986 | Sirois | 181/175 |
| 4,719,322 | 1/1988 | Guzik et al. | 200/5 A |
| 4,965,483 | 10/1990 | Abe et al. | 381/190 |

*Primary Examiner*—David K. Moore

*Attorney, Agent, or Firm*—Paul K. Godwin, Jr.; Roger L. May

[57] ABSTRACT

An audio speaker configured for simple manual or automatic robotic insertion into an enclosure aperture so that it will be electrically connected to an audio signal transmission medium and retained within the enclosure. The speaker includes a latching mechanism and a pair of coplaner electrically conductive contact pads concentrically oriented and disposed on the back of the speaker. The pads are disposed so as to contact a pair of relatively fixed electrical terminals mounted on the enclosure, independent of any rotational orientation of the speaker.

8 Claims, 3 Drawing Sheets

AUDIO SPEAKER CONNECTOR EMPLOYING CONCENTRICALLY ORIENTED SPEAKER CONTACTS

FIELD OF THE INVENTION

This invention is directed to the field of electrical connectors and more specifically to the area of providing electrical connection between audio speakers and associated audio driver circuitry.

BACKGROUND OF THE INVENTION

Audio speakers are conventionally known in the prior art to include a protective frame or housing, a diaphragm (cone), a suspended driving mechanism connected to the diaphragm and an electrical actuator for mechanically moving the driver element. The actuator is normally a voice coil that has electrical conductors connected to external plus and minus polarity electrical terminals on the speaker housing. In many cases, the terminals extending from the speaker are soldered directly to audio signal wires and in others, an electrical connector from a wiring harness is attached to the speaker terminals.

SUMMARY OF THE INVENTION

In the present invention, one object is to provide an audio speaker connector in which electrical connection is automatically made, between the speaker terminals and the wiring harness containing the audio signal wires, as the speaker is inserted into an opening in a speaker mounting panel or enclosure.

It is another object of the present invention to provide an audio speaker in which electrical connection is made to associated audio driver circuitry by inserting the speaker into the enclosure opening without regard to its axial orientation.

It is another object of the present invention to provide an audio speaker connector that automatically mates with the electrical output terminals and said mating is maintained while said speaker is latched in place in the enclosure opening.

It is a further object of the present invention to provide a latching mechanism for an audio speaker that is suitable for simple manual or automatic robotic installation into an enclosure or panel opening with simple assembly requirements and no separate mounting hardware.

The audio speaker connector of the present invention provides an electrical connection to both leads of a diaphragm actuator that is resident in the speaker. The connection is made with the output wiring extending from an associated audio amplifier when the speaker is installed and latched into an opening in a speaker enclosure. The connector includes a first conducting contact pad that is centrally located on the defined back of the speaker and electrically connected to one electrical end of the diaphragm voice coil actuator. The connector further includes a second conducting contact pad that is concentrically disposed around and electrically connected to the other electrical end of the diaphragm actuator. The first and second contact pads are electrically insulated from each other, except through the diaphragm actuator. The invention also includes means on the speaker for latching the speaker inserted into the opening of the speaker mounting panel or enclosure. Within the speaker mounting area of the panel, a mating speaker connector assembly is provided which includes two resilient terminals. The resilient terminals are embedded in an insulator block that is connected to the panel. The assembly is positioned on the mounting panel such that the mating terminal contact areas correspond to the related electrical contact pad areas on the speaker when the speaker is mounted and latched in the mounting panel.

The simple configuration of the speaker electrical contact pad areas and the associated fixed set of terminals on the connector assembly facilitate the objects as expressed above.

DETAILED DESCRIPTION OF THE PREFERRED EMBODIMENT

Figure 1:
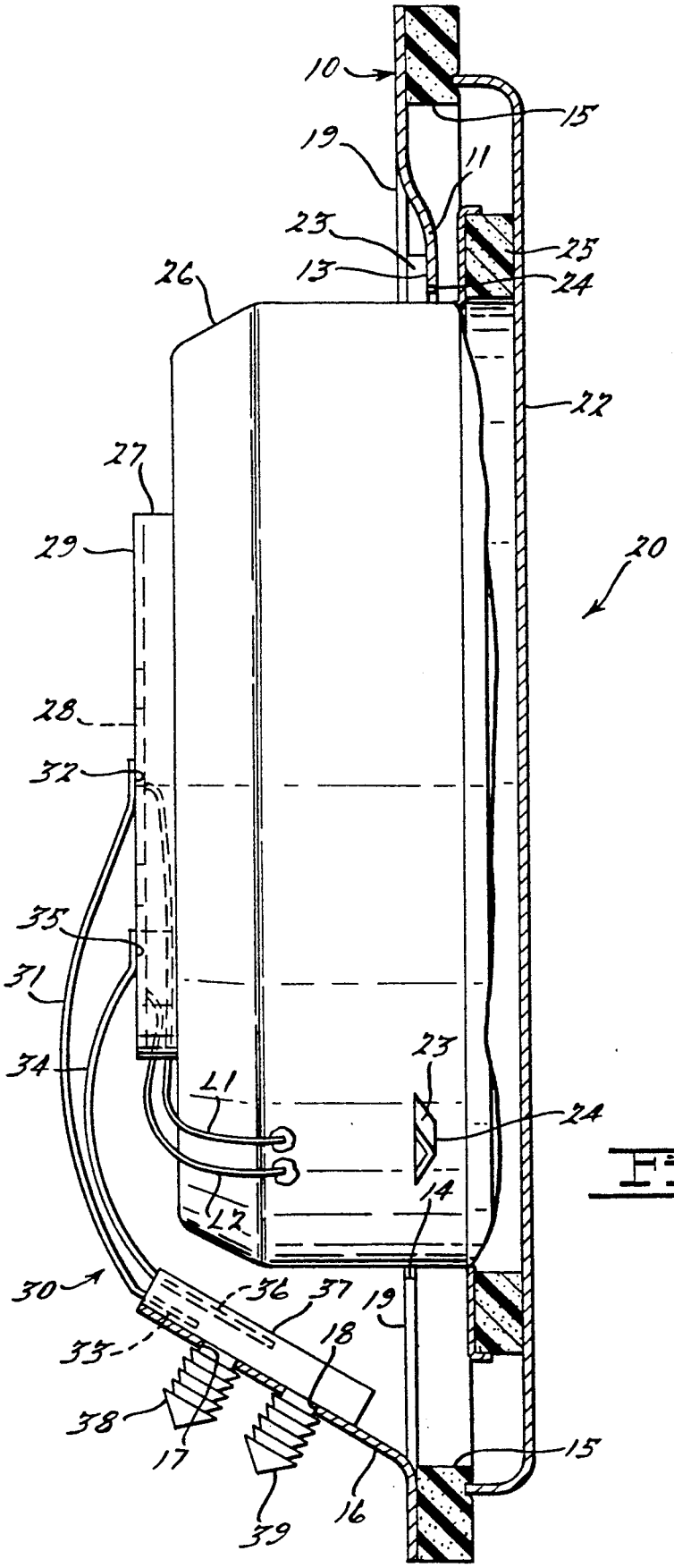
FIG. 1 is an elevational cross section, taken along lines I—I in FIG. 2, of a speaker enclosure containing a speaker connector of the present invention with the speaker latched therein.
Figure 2:
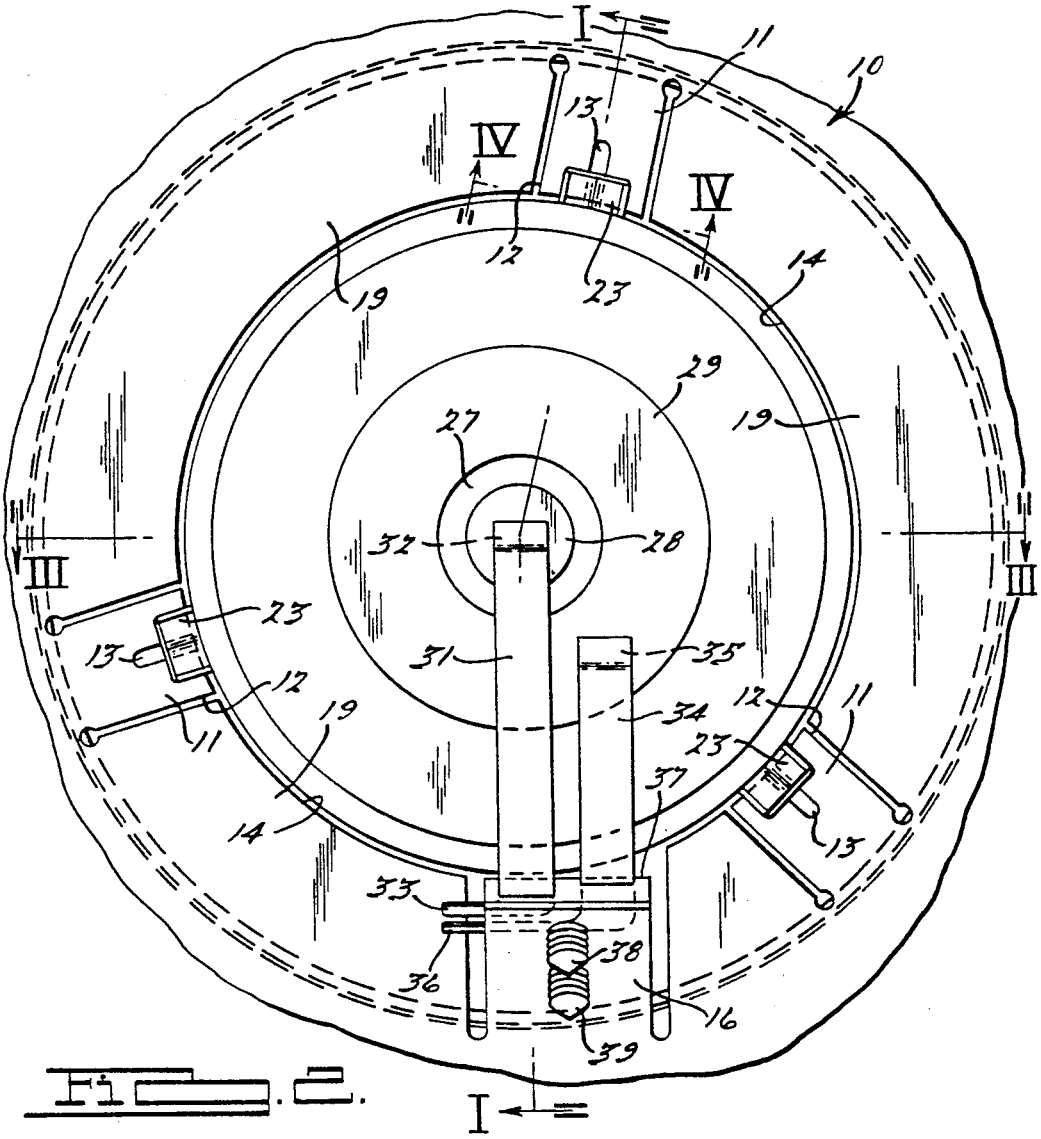
FIG. 2 is a plan view of the rear portion of the speaker mounted within the panel mounting enclosure.
Figure 3:
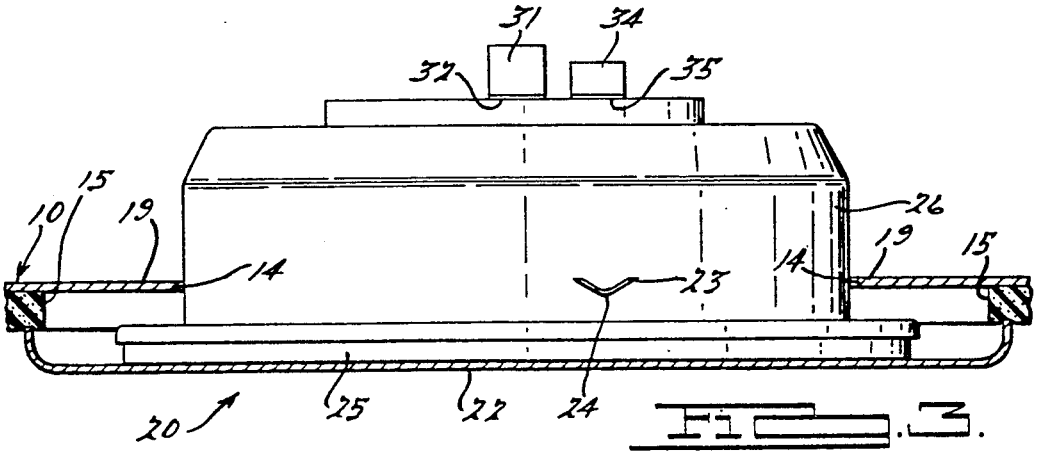
FIG. 3 is a partial cross section of the speaker taken along lines III—III in FIG. 2.

With simultaneous reference to FIGS. 1–3, the invention is shown embodied in the speaker assembly 20 mounted in an aperture 14 of a metal mounting enclosure panel 10. Enclosure panel 10 includes a sheet metal speaker mounting plate 19 with a doughnut shaped sealing gasket 15 mounted on the front surface of the plate 19.

The aperture 14 is formed in the sheet metal plate 19 to correspond to the circular profile of the cylindrical housing frame 26 of the speaker 20. The sealing gasket 15 is shown in this case as having an aperture with a diameter that is somewhat larger than the aperture 14. The sealing gasket 15 is preferrably a neoprene sponge type material and the aperture 14 is sufficiently sized so as to be hidden by the front grille 22 of the speaker 20 when mounted in the enclosure panel.

The sheet metal plate 19 contains a plurality of resilient cammed tabs 11 which are formed in the sheet metal plate 19 so as to be cantilevered towards the opening 14. The cammed tabs 11 each have one corner 12 that is bent forward of the front surface of the plate 19 (see FIG. 4A) so as to provide a camming surface on rear surface of the tab. The tabs 11 also contain detents 13 formed on their rear surfaces and serve to interact with V-shaped detent tabs 23 extending from the speaker housing frame 26 to latch the speaker 20 in place.

The speaker 20, in this embodiment, includes a conventional voice coil actuator (not shown) which drives a suspended diaphragm (not shown) to produce mechanical sound waves. The front of the speaker is shown covered by a protective grille cover 22 having a diameter which corresponds to contact the sealing gasket 15. The speaker 20 includes a cylindrically shaped housing frame which contains the internal workings of the speaker (the voice coil and diaphragm). The front opening of the speaker is surrounded by a resilient cushioning material that resides between the housing 26 and the grille cover 22.

Electrical connection between the audio output driver circuitry (not shown) and the speaker is provided through an electrical terminal assembly 30 mounted on a tab 16 extending from the sheet metal plate 19 and a contact pad assembly which is an integral part of the speaker 20.

The terminal assembly 30 includes a pair of resilient cantilevered spring terminals 31 and 34 which contain respective terminal contact areas 32 and 35. The resilient cantilevered terminals 31 and 34 are preferrably made of a conductive spring metal, with a noncorrosive plating, and are retained in a molded insulator 37. The insulator 37 is connected to the tab 16 with a pair of one way insertion elements 38 and 39. The insertion elements 38 and 39 are inserted through apertures 17 and 18 in the tab 16 and permanently held therein. The resilient terminals 31 and 34 are also provided with rigid spade lug terminal portions 33 and 36, respectively. The rigid spade lug terminal portions 33 and 36 extend from the insulator 37 so as to be mated with a conventional female lug connector (not shown) which extends from a wiring harness. The wiring harness is connected, of course, to the output of an audio amplifier and serves to transmit the audio electrical signal to the terminals 31 and 34.

The speaker 20 contains two electrical contact pads 28 and 29 mounted at the rear thereof so as to contact the terminal areas 32 and 35, respectively.

The contact pad 28 of the speaker 20 is centrally located on the back of the housing 26 and is electrically connected to the diaphragm actuator through line L1. The center contact pad 28 defines an unbroken circular conducting surface. The contact pad 29 is concentrically disposed around, but separated from the first contact pad 28. Contact pad 29 defines a flat annular surface and is electrically connected to the . diaphragm actuator through line L2. The speaker contact pads 28 and 29 are configured so as to mate with the relatively fixed set of terminal areas 32 and 35 no matter what the rotational orientation of the speaker may be as it is inserted and mounted into the enclosure panel 10. In this embodiment, the contact pads 28 and 29 are coplanarly mounted on an insulator block 27. It is forseen that such contact pads could be in the form of printed circuit patterns on a planar substrate.

Lines L1 and L2 are shown as being routed external to the housing 26, for illustration purposes. It is expected that a commercial version would embed those lines internal to the housing and the insulator block 27.

Figure 4A:
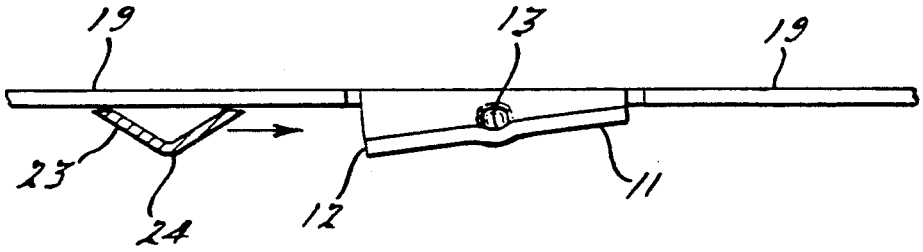
FIG. 4A is a detailed plan view of a portion of the latching mechanism used in the present invention.
Figure 4B:
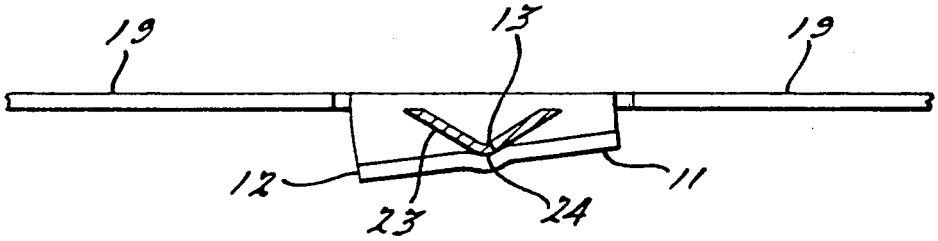
FIG. 4B is a detailed plan view of that portion of the latching mechanism as taken along lines IV—IV in FIG. 2.

Upon insertion of the speaker 20 into the aperture 14 from the direction of the front of the enclosure panel 10, the speaker grille 22 contacts the sealing gasket 15 and, as shown in FIG. 4A, the locking detent tabs 23 may contact the front surface of plate 19. When the speaker 20 is fully inserted into the aperture 14, it is rotated counterclockwise so that each of the V-shaped locking tabs 23 ramp the corner 12 of a corresponding tab 11 in a direction that is opposite the insertion direction. As shown in FIG. 4B, the point 24 on each of the V-shaped tabs 23 cams against the rear surface of the corresponding tab 11 until it mates with detent 13, where it is latched by a high friction connection.

The invention, as described, is highly suitable for simple manual or automated robotic installation techniques, since the enclosure panel can be supplied to the manufacturing facility completely wired and ready to accept the speaker with a minimal amount of dexterity.

It is foreseen that other locking techniques may be employed whereby the speaker is mounted and retained in the enclosure through a mechanism which is retained on the speaker and interacts with the enclosure.

It will further be apparent that many modifications and variations may be implemented without departing from the scope of the novel concept of this invention. Therefore, it is intended by the appended claims to cover all such modifications and variations which fall within the true spirit and scope of the invention.

I claim:

1. An audio speaker assembly for providing an electrical connection between the diaphragm actuator resident in a cylindrical housing of an audio speaker and the output wiring for an associated audio amplifier when said speaker is installed and latched into the front of an associated speaker panel having a circular aperture formed therein that is slightly large than said cylindrical housing, comprising:

a first conducting contact pad being centrally located on the defined back of said speaker housing and electrically connected to said diaphragm actuator;

a second conducting contact pad being concentrically disposed around said first contact pad on said speaker housing and electrically connected to said diaphragm actuator, wherein said first and second contact pads are electrically insulated from each other, except through the diaphragm actuator;

said speaker panel contains a plurality of cantilevered tabs disposed around and extending radially towards the circular edge of said panel aperture;

tab means radially extending from the cylindrical surface of said speaker housing beyond the diameter dimension of said panel aperture to interfere with and cause corresponding ones of said cantilevered tabs to bend towards the rear of said panel as said speaker is inserted from the front of said panel and into said aperture until said tab means extend behind said panel and to release said cantilevered tabs from bending when said speaker is rotated after insertion, thereby allowing said tab means to contact the rear of said speaker panel and latch said speaker in said aperture of said speaker panel;

a relatively fixed set of electrical terminals mounted behind said panel and configured to be connected to said wiring harness, wherein said set of terminals includes a first terminal that is resiliently mounted in a position corresponding to the center of said aperture for mating with said first contact pad, and a second terminal that is resiliently mounted in a position adjacent to said first terminal and spaced therefrom by a distance that is sufficient for mating with said second contact pad when said speaker is inserted in said aperture.

2. An assembly as in claim 1, wherein said first and second contact pads are generally planar and circular in shape.

3. An assembly as in claim 2, wherein said first and second contact pads lie in a common plane.

4. An assembly as in claim 2, wherein said first contact pad defines an unbroken circular surface.

5. An assembly as in claim 1, wherein said mating between said first contact pad and said first terminal and said second contact pad and said second terminal is independent of the rotational orientation of said speaker about the centrally located first contact pad.

6. An audio speaker assembly as in claim 1, wherein said cantilevered tabs contain detents which provide frictional indexing and retention of said speaker tab means when said speaker is sufficiently rotated after being inserted into said panel aperture.

7. An audio speaker assembly as in claim 1, wherein said speaker contains a flange element that is larger than the circular aperture in said panel and limits the distance the speaker can be inserted into said aperture.

8. An audio speaker configured for insert and twist mounting from the defined front side of an circularly apertured panel so as to achieve electrical connection of a diaphragm actuator in said audio speaker to resilient output terminals mounted on the rear of said panel and connected to an associated audio amplifier when said speaker is inserted and to achieve latching retention of said speaker in said panel when said inserted speaker is subsequently twisted, wherein said panel contains a plurality of cantilevered tabs extending radially towards and forming part of the edge of said aperture, said speaker comprises:

a cylindrical speaker housing surrounding said diaphragm actuator;

a first conducting contact pad being centrally located on the defined back of said cylindrical speaker housing and electrically connected to said diaphragm actuator;

a second conducting contact pad being concentrically disposed around said first contact pad on said speaker housing and electrically connected to said diaphragm actuator, wherein said first and second contact pads are electrically insulated from each other, except through the diaphragm actuator;

tab means radially extending from the cylindrical surface of said speaker housing beyond the diameter dimension of said panel aperture to interfere with and cause corresponding ones of said cantilevered tabs to bend towards the rear of said panel as said speaker is inserted into said aperture from the front of said panel until said tab means extend behind said panel and to release said cantilevered tabs from bending when said speaker is twist rotated after insertion, thereby allowing said tab means to contact the rear of said speaker panel and latch said speaker in said aperture of said speaker panel;

said first and second conducting contact pads make corresponding electrical contact with said resilient terminals during the insertion of said speaker into said aperture and continue such contact during subsequent rotation and latching.

* * * * *